United States Patent [19]

Ritzenhoff

[11] 4,149,647

[45] Apr. 17, 1979

[54] METAL TEAR OFF CAP

[75] Inventor: Hermann Ritzenhoff, Marburg, Fed. Rep. of Germany

[73] Assignee: Gebruder Seidel KG, Marburg, Fed. Rep. of Germany

[21] Appl. No.: 802,459

[22] Filed: Jun. 1, 1977

Related U.S. Application Data

[62] Division of Ser. No. 718,109, Aug. 27, 1976, abandoned.

[51] Int. Cl.[2] ..... B65D 41/32

[52] U.S. Cl. ..... 215/254

[58] Field of Search ..... 215/251, 254, 256

[56] References Cited

U.S. PATENT DOCUMENTS

| | | | |
|---|---|---|---|
| 1,712,103 | 5/1929 | Carvalho | 215/256 |
| 1,875,431 | 9/1932 | Fabrice | 215/251 |
| 3,042,243 | 7/1962 | Ritzenhoff | 215/256 |
| 3,142,402 | 7/1964 | Fox | 215/256 |
| 3,145,869 | 8/1964 | Ritzenhoff | 215/256 |
| 3,692,200 | 9/1972 | Ritzenhoff | 215/256 |

FOREIGN PATENT DOCUMENTS

| | | | |
|---|---|---|---|
| 1079 | 3/1931 | Australia | 215/254 |
| 718735 | 9/1965 | Canada | 215/256 |
| 962374 | 7/1964 | United Kingdom | 215/251 |

*Primary Examiner*—Ro E. Hart

*Attorney, Agent, or Firm*—Hopgood, Calimafde, Kalil, Blaustein & Lieberman

[57] ABSTRACT

A metal cap for crimping on the neck of a container has one or two tear lines of reduced strength about its skirt which define a tear-off strip. A perforation for initiating tearing extends across the width of the strip and at least one smaller perforation is also provided in the strip. A tear-off tab (plastic tape) engages both sides of the strip and is joined together through the perforations. The larger perforation is either U- or L-shaped, a straight slot or variations thereof. The portion of the tear line adjacent the larger perforation may be scored to facilitate initial rupture in the desired direction. One or more circumferential reinforcing ribs may be provided in the skirt on one or both sides of the tear-off strip. In addition to the full circumferential tear line, a partial tear line may extend between the larger perforation and a slot in the edge of the cap to provide an initially narrow tear-off strip, which enlarges to include the edge of the cap.

4 Claims, 10 Drawing Figures

METAL TEAR OFF CAP

This application is a division of my copending streamline continuation application, Ser. No. 718,109, filed Aug. 27, 1976, which is turn was based on parent application, Ser. No. 313,460, filed Dec. 8, 1972, (now abandoned).

The present invention concerns a metal tear-off cap which acts as a pressure closure means and can be secured by crimping on to the neck of a container, the cap having a tear-off strip extending around the cap surface, bounded by at least one tear line of reduced strength, a portion of the tear-off strip being covered by a foil.

Among the requirements for an ideal pressure closure means are that it should provide a good seal and it should be capable of ready removal without the use of a tool or implement. The closure means desirably should show whether the original contents of the bottle have been tampered with, and it must be hygienic and have no adverse effect at all upon the contents of the bottle. However, many existing pressure closure means fail to meet all the above requirements. Thus, for example, the known screw-on caps do not guarantee that the original contents of the container have not been interfered with, and crowned caps cannot be removed without the use of an implement.

There are existing metal tear-off caps for sealing bottles and other containers, which have a tear-off strip, a portion of the tear-off strip being covered by a foil or film. German Pat. No. 1,204,544, for example, describes a tear-off cap, part of the tear-off strip of which is formed to provide a holding tab by means of a perforation of the cap skirt, the perforation for said holding tab being covered by a foil also extending around the latter, which foil may project over the free end of said holding tab and can be secured to the holding tab through openings.

This and other tear-off caps with a tear-off strip and a punched-out holding tab — with and without covering foil — which are to be secured on to the neck of a container by crimping, have the disadvantage that they cannot be used as pressure closure means since the skirt surface of the cap is radially perforated along the length of the holding tab. If after closing a container by means of such a tear-off cap, an axial pressure is exerted upon the cap from inside by the contents the skirt surface normally compressed onto the neck of a container arches upwardly above the longer radial perforation despite the crimping; and the seal is destroyed.

Furthermore, the holding tabs produced by punching operations have the disadvantage that a hardening of the material occurs all around the cut edges. Such a hardening interferes with the functioning of the holding tab at the two points where the holding tab ends and the tear-off strip starts. The undesirable initial resistance which occurs when pulling off the tear-off strip greatly hinders opening of the container. An even greater disadvantage are tears in undesired directions produced as a result of the hardening, which prevent the proper functioning of the cap.

A further disadvantage of the known tear-off cap is that in their production a sensitive punching tool is required for punching out the holding tab. Since the holding tab is connected with the tear-off strip only at one narrow side for securing the foil or film the other three sides are free, there must be a tongue of appropriate shape in the matrix of an appropriate punching tool. This free narrow tongue of the tool is extremely sensitive to shock and pressure and therefore not well suited for robust mechanical production with several hundreds of punchings per minute.

This tool construction causes the further disadvantage that for the tear-off strip one must not exceed a minimum height required to fasten the free tongue in the matrix. Thus, the shape of the holding tab necessarily determines the height of the tear-off strip and therefore influences the total height of the cap. For this reason, the tear-off strip cannot be formed in a narrower size, which would make it possible to reduce the height of the cap. In the production of an enormously large number of caps, even a small reduction in height would afford a very large saving of material and cost.

In addition, the long radial perforation of the cap skirt interferes with the smooth passage of the cap through the feed mechanism and the machine. The cap skirt, which has reduced strength due to the perforation for the holding tab, tends to be dented at the high transport rates in the sorting and conveying systems, which damage the caps and interfere with their transportation.

The invention is directed to the object of providing a simple and economical metal tear-off cap having a tear-off strip and foil on one portion of the tear-off band to be secured on to the neck of a container by crimping, which cap is useful as pressure closure means and meets all the above requirements to be met by a pressure closure means.

According to the invention there is provided a metal closure cap arranged to be secured to the neck of a container by crimping, the cap having a tear-off strip extending around the cap bounded by at least one tear line of reduced strength relative to the rest of the metal of the cap, wherein the tear-off strip starts at one perforation, at least one other perforation narrower than the strip is formed in the strip, and a holding tab is secured to the strip through the perforations.

In order that the invention can be fully understood and readily carried into effect, it will now be described in greater detail with reference to the accompanying drawings, in which:

FIG. 1 is a lateral view in elevation of one example of a cap in accordance with the invention before the holding tab has been secured, the subsequent position of the tab being marked in phantom outline;

FIG. 1*a* is a partial section of the line c—c through FIG. 1, after the two piece holding foil has been applied;

Figure 5:
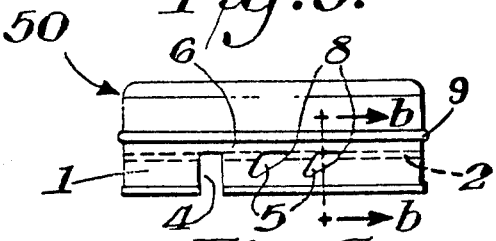
FIG. 5 is a front view in elevation of a further cap according to the invention before the holding tab is applied.
Figure 6:
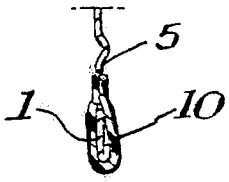
FIG. 6 is a partial section on the line b—b through FIG. 5, after a one-piece holding tab has been applied.
Figure 7:
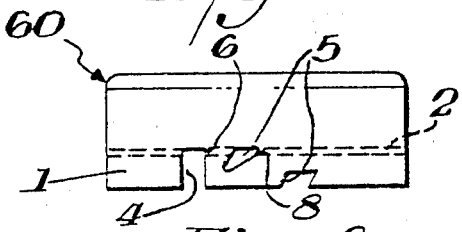
Figure 6A:
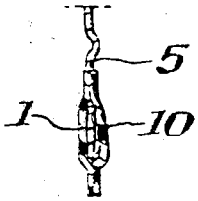
Figure 8:
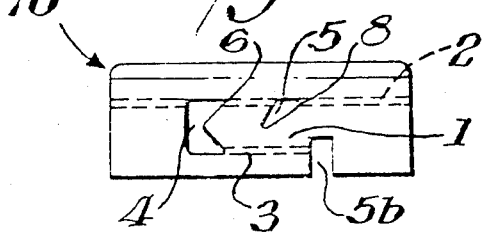

FIG. 6*a* shows a partial section on the line b—b through FIG. 5 after a two-piece holding tab is applied;

FIG. 7 is a front view in elevation of a still further cap according to the invention before the holding tab is applied; and FIG. 8 is a front view in elevation of still a further cap according to the invention before the holding tab is applied.

Figure 1:
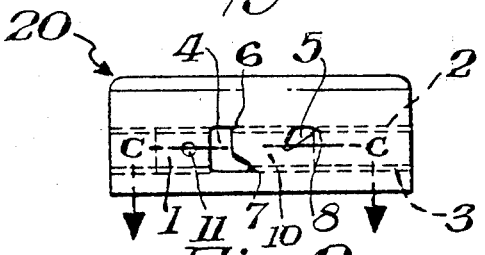

FIG. 1 shows a tear-off cap 20 made of one of the metals usually employed, preferably aluminum, which cap comprises a tear-off strip 1 formed by two tear lines 2 and 3 of reduced strength. Tear lines 2 and 3 are lines of reduced cross section on the inner surface of cap 20, which will be disposed next to the container when cap 20 is attached to it. The tear-off strip 1, which extends completely around the cylindrical body of the cap, is interrupted at one point by a major punched-out portion or perforation 4. To the rear of the punched-out portion in the direction of tearing or pull is an opening or smaller perforation 5. The punched-out portion 4 has two tear-initiating points 6 and 7, and the opening 5 has one such point 8. The tear-initiating points are located on the tear lines 2 and 3, and are scored at points 18 on the outer surface (see FIG. 4) in order to avoid incorrect tearing. The scoring is carried out during the punching operation by means of an appropriate form of die and in such manner that the work-hardening of the cut edges normally occurring during punching is avoided at each tear-initiating point.

Figure 1A:
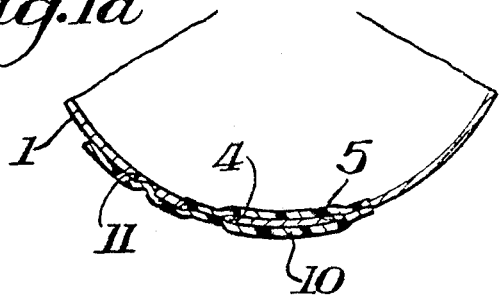
Figure 2:
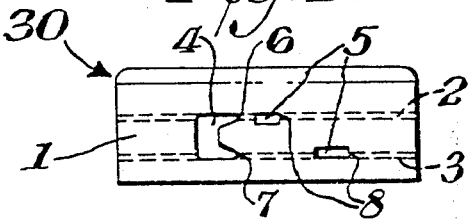
FIG. 2 is a front view in elevation of another cap according to the invention before the holding tab is applied.

FIG. 1*a* shows a section through the tear-off cap of FIG. 1 after a two-piece holding tab 10 has been secured to the tear-off strip 1. The tab 10 is formed of a film or foil of, for example, plastics material bonded or welded on to itself through the opening 5. Foil 10 is, for example, a tear resistant plastic tape of polyethylene, terephthalate, polypropylene or high density polyethylene. This bonding or welding is preferably effected by ultrasonic welding. A similar joint is also made through the punched-out portion 4. The outer portion of the holding tab 10 projects forwardly of the punched-out portion 4 and this projecting portion can be gripped to tear off the strip 1. To prevent trouble occurring when the cap passes through the feed mechanism, the projecting portion of the holding tab 10 can be held close to the cap by means of a very small punched-out hole 11 in the tear-off strip 1 and located forwardly of the punched-out portion 4. The tab is pressed into the hole 11 for example by means of a small punch to hold the tab down. The hole 11 may alternatively be a jagged shape.

Figure 3:
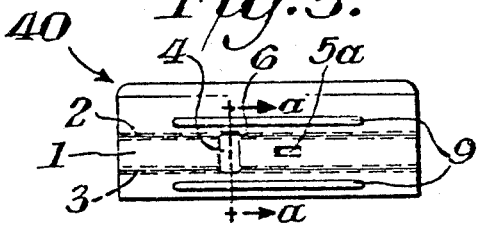
FIG. 3 is a front view in elevation of still another cap according to the invention before the holding tab is applied.

In the case of the cap 40 arrangement shown in FIG. 3, an opening 5*a* is formed in the middle of the tear-off strip 1 and to the rear of the punched-out portion 4. FIG. 3 also shows that reinforcing ribs 9 can be formed above and below the punched-out portion 4 and the opening 5*a*. The positions of the reinforcing ribs 9 and the punched-out portion 4 are also shown in section in FIG. 4.

Figure 4:
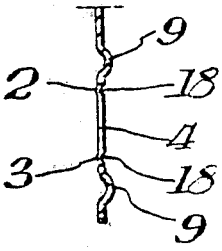
FIG. 4 is a partial section on the line a—a through FIG. 3.

Whereas FIGS. 1 and 4 show tear-off caps each comprising a tear-off strip 1 bounded by two tear lines 2 and 3 of reduced strength, FIGS. 5 to 7 illustrate caps in which the tear-off strip 1 is located at the lower end of the cylindrical body of the cap and is bounded by only a single tear line 2 of reduced strength.

In both cases, i.e., with the tear-off strip at the lower end of the cap or placed intermediately, the ability of the cap to withstand internal pressure is particularly good when the tear line 2 or lines 2 and 3 are located around the cylindrical part of the cap. However, an additional tear line may run axially along the cap.

FIGS. 5 and 7 illustrate two examples of tear-off caps 50 and 60, each of which has two openings 5, but which are differently arranged. In this case too, tear-initiating points 6 and 8 are formed by scoring. The cap 50 seen in FIG. 5 also includes a reinforcing rib 9 located above the punched-out portion 4.

FIG. 6 shows in section a possible way of securing a one-piece holding tab 10 through the opening 5, in the case of the tear-off cap 50 shown in FIG. 5. One piece tab 10 is similar in length and application to tab 10 of FIG. 1.

FIG. 6*a* is a section through the attachment arrangement for a two-piece holding tab 10 again in the case of the cap 50, illustrated in FIG. 5, the film being welded on to itself through the opening 5 and also below the edge of the cap. Two-piece tab 10 is also similar in length and application to tab 10 of FIG. 1.

FIG. 8 illustrates a further tear-off cap 70 containing two openings 5 and 5*b*, the second opening 5*b* extending vertically downwardly from the lower tear line 3 and through to the edge of the cap. In this case, the lower tear line 3 is formed only along the relatively short distance between the punched-out portion 4 and the second opening 5*b*. In this way a tear-off strip of two different widths is obtained, since to the rear of the vertical opening 5*b* in the direction of tearing or pull the width of the tear-off strip 1 is increased to an extent equal to the vertical dimension of the vertical opening 5*b*. By means of this arrangement, the whole lower edge of the cap is torn-off.

What is claimed is:

1. An aluminum sealing cap for crimping upon the neck of a container, comprising a top, a substantially cylindrical skirt integrally joined to said top, at least one tear line of reduced strength circumferentially disposed about said skirt for defining a tear-off strip relative to the remainder of said cap, a major perforation through said cap in said tear-off strip and extending across its axial width for initiating its separation from said remainder of said cap, said major perforation being of limited circumferential length whereby said cap is in itself capable of sealing the neck of the container to retain substantial internal pressure within the container, at least one smaller perforation in said tear-off strip and narrower than said tear-off strip, said smaller perforation being wholly contained by said tear-off strip and spaced from the axial limits of said tear-off strip, said smaller perforation being also near but angularly offset in one direction from said major perforation, a holding tab of strong tear-resistant plastic tape secured to said tear-off strip through said smaller perforation and disposed on both sides of said tear-off strip for grasping and forceably initiating the separation and for separating said strip from said cap, said tape having inner and outer portions overlapping inner and outer surfaces of said tear-off strip and extending in overlap with said perforations and with that part of said tear-off strip which is between said perforations, said tape portions being joined to each other and to said tear-off strip by ultrasonic tape-to-tape welds through said major and smaller perforations, whereby said tape is remarkably strongly attached to said tear-off strip before and throughout a strip-tearing operation.

2. The aluminum sealing cap of claim 1, in which said skirt includes a reinforcing rib formation axially above said tear line and extending angularly for at least an angular span which overlaps the angular span of and between said perforations.

3. The aluminum sealing cap of claim 1, in which said tear line is the upper one of two axially spaced tear lines defining the axial limits of said tear-off strip.

4. The aluminum sealing cap of claim 3, in which said skirt includes a first reinforcing rib formation axially above the axially upper tear line and extending angularly for at least an angular span which overlaps the angular span of and between said perforations, said skirt also including a second reinforcing rib formation axially below the axially lower tear line, said second reinforcing rib formation extending axially for at least an angular span which overlaps the angular span of and between said perforations.

* * * * *